US006523971B1

(12) United States Patent
Nikl

(10) Patent No.: US 6,523,971 B1
(45) Date of Patent: Feb. 25, 2003

(54) ANTI-TAMPER DEVICE

(76) Inventor: Antun Nikl, 13896-94A Ave., Surrey B.C. (CA), V3V 1N2

( * ) Notice: Subject to any disclaimer, the term of this patent is extended or adjusted under 35 U.S.C. 154(b) by 187 days.

(21) Appl. No.: 09/613,763

(22) Filed: Jul. 11, 2000

(30) Foreign Application Priority Data

Jul. 26, 1999 (CA) ..... 2278906

(51) Int. Cl.[7] ..... F21V 33/00

(52) U.S. Cl. ..... 362/154; 362/253

(58) Field of Search ..... 362/100, 116, 362/154, 253; 109/50, 52; 70/63

(56) References Cited

U.S. PATENT DOCUMENTS

| | | | | |
|---|---|---|---|---|
| 4,655,145 A | | 4/1987 | Naylor | |
| 5,235,920 A | | 8/1993 | Hector | |
| 5,573,109 A | * | 11/1996 | Isacson | 362/154 |
| 5,590,608 A | * | 1/1997 | Yore et al. | 109/50 |
| 5,738,020 A | * | 4/1998 | Correia | 109/51 |

FOREIGN PATENT DOCUMENTS

| | | | | |
|---|---|---|---|---|
| DE | 29935 | * | 9/1907 | 362/154 |

* cited by examiner

*Primary Examiner*—Sandra O'Shea
*Assistant Examiner*—Peggy A. Neils
(74) *Attorney, Agent, or Firm*—Frederick Kaufman

(57) ABSTRACT

Anti-tamper device for protecting a lock box or another locking devices comprises a three-dimensional enclosure securely fastened to a bottom plate. The latter is adapted to be firmly attached to a vertical wall. First and second obstructing panels are located in the enclosure. The first obstructing panel extends from the top of the enclosure at the entrance of it. The second obstructing panel is parallel to the first obstructing panel and extends from the bottom plate. Between the extensions of the first and second obstruction panels, a passage is formed. This passage is so dimensioned so as:

1. To let the insertion of a hand with a key in it, only;
2. To render impossible, from the exterior of the enclosure to see a lock box or other locking device, disposed behind the second obstructing panel; and
3. To render unsuccessfully any attempt to damage the locks of a lock box or another locking device by using a straight tool.

6 Claims, 4 Drawing Sheets

ANTI-TAMPER DEVICE

BACKGROUND OF THE INVENTION

1. Field of the Invention

The invention relates generally to security boxes and, more particularly, to an anti-tamper device that is basically jimmy-proof and not susceptible to let Unauthorized access to a lock box or another locking device located in the anti-tamper device.

2. Description of the Prior Art

Lock boxes are extensively used in apartment buildings to enable access, when the building manager is not available, to authorized persons, such as repairmen, servicemen, real-state agents and firemen. Otherwise, it would be impractical to have different key for every property that they have to access. It is known that lock boxes are vulnerable to acts of burglary and vandalism by those who often attempt to gain access to the keys deposited therein.

Without question, the field of protection against theft, burglary and vandalism is very active and the need for an improved anti-tamper device to protect lock boxes against breaking is very actual. In recent years, there have been great improvements in the mentioned field. But, despite these improvements, the protection devices still suffer from drawbacks, which are seemingly inherent in their basic design concepts. Thus, their ability to deter potential intruders from trying to break a lock box is limited. Attempts have been made in the past to develop an improved anti-tamper device. U.S. Pat. No. 5,738,020, dated Apr. 14, 1998 and granted to Correia for a "Lock box and mounting device" teaches a combination lock box and mounting device. The lock box includes a back wall having a plurality of keyhole openings therein and a lid having a closed position and an open position. The mounting device comprises a mounting bracket and a locking plate. The mounting bracket is secured to a supporting surface and included a plurality of flared head shafts extending through the keyholes of the lock box. The locking plate has a plurality of keyhole openings and is inserted into the lock box to a locking position. In this position, the keyholes of the locking plate receive the shafts of the mounting bracket and lock the lock box onto the mounting bracket. The lid, in the closed position, retains the locking plate in its locking position. Although the above patent offers an interesting solution, no anti-tampering features are provided. The lock box and mounting device developed by Correia is considered to have two disadvantages. First, there are gaps between the lock box back and the wall on which the lock box is attached, and between the lid and walls of the lock box. These gaps are susceptible to having a jimmy-bar hammered into and pried to—and—pro which will destroy the box or allow it to be taken away entirely. Second, there is a direct access to the lock, which can be drilled or picked or damaged to permit access to the interior of lock box.

U.S. Pat. No. 5,590,608, dated Jan. 7, 1997 and granted to Yore et al. for a "Lockable lock box mounting assembly and method" describes a lock box mounting assembly for removably mounting a lock box to the hinge-edge of a door. The mounting assembly comprises a U-shaped bracket for mounting to a hinge-edge of a door, between the door and its jamb. The outer lag of the U-shaped bracket has a mounting eye-defining structure extending outwardly. This structure has an opening therein adapted to receive a lock box shackle member there through for coupling a lock box to the bracket. There are two drawbacks to this mounting assembly. First, the mounting eye-defining structure and the lock box shackle member can be easily pried. Second, the lock of the lock box is frontally situated, and therefore, can be hammered and so damaged as to allow the opening of the lock box and access to the key within.

U.S. Pat. No. 3,610,177, dated Oct. 5. 1971 and granted to Shapiro for a "Security enclosure" discloses a housing having a cylindrical wall with a base member permanently attached to close one end of the cylinder. A removable second closure member with two tabs is fitted within the outer end of the cylinder, with one tab extending through the opening of the wall of the cylinder and the other tab aligned with a matching lug, formed from the wall of the cylinder. The tab and lug are secured together by means of a lock padlock or other secure means. In its security enclosure configuration, Shapiro's structure has a number of shortcomings. First, the security enclosure can be taken away as an entity, since no feature to attach it to a rigid structure, such a main wall of building, is provided. Second, since a lock or padlock, usually, cannot provide a tight contact between the tab and the lug, a gap is formed. Thus, the possibility of inserting a pry between the two elements exists. Third, the removable second closure contains an elongated slot opening, which allows the introduction in it, for the purpose of prying, of a crow bar.

The inventor believes that the cited disclosures, taken alone or in combination, neither anticipates nor renders obvious the present invention. The foregoing citation does not constitute an admission that such disclosures are relevant or material to the claims. Rather, the disclosures relate only to the field of the invention and are cited as constituting the closest art of which the inventor is aware.

SUMMARY OF THE INVENTION

Accordingly, objects of the present invention include the overcoming of disadvantages and shortcomings of the type discussed above.

Other objects become apparent from the following disclosure.

Broadly speaking, the anti-tamper device comprises an enclosure forming a unitary structure with a bottom plate, the latter being adapted to be permanently secured to a wall. The enclosure contains a top panel, a pair of side panels and a back panel. First and second obstructing panels are also incorporated in the enclosure. The first obstructing panel extends from the top panel and is disposed perpendicularly to it, at the entrance of the enclosure. The second obstructing panel is parallel to the first and extends from the bottom plate, in the interior of the enclosure. A space adapted for a hand with a key access is formed between the first and second obstructing panels. The space, adapted for a hand with a key access communicates with a hollow area behind the second obstructing panel. The bottom plate in the hollow area is provided with means for accommodating one or more locking devices. The space for only a hand with a key access is so chosen, that there is not visibility from the outside of the enclosure, so as to ascertain whether there are locking devices in the enclosure and, especially, the position of their locks. The mentioned space offers no possibility of inserting a prying instrument capable of reaching and damaging the locks.

Optionally, the anti-tamper device, conform the present invention, may comprise an elongated metallic mirror, firmly attached to the bottom plate, at the entrance of the enclosure, and a plane-intersecting metallic mirror, removably attached to the back and top panels. The plane-intersecting mirror is slantingly disposed with respect to the back and top panels and is adapted to reflect the image of a locking device and the position of its lock. Means is provided for removable attaching the plane-intersecting metallic mirror to the back and top panels. Also, light means is provided in the interior of the enclosure, for directing light to the locking device.

In one aspect of the invention, in the case of large enclosures, use is made of an intermediary-reinforcing panel, disposed perpendicularly to the bottom plate and top panel, to both of which it is firmly fastened.

In another aspect, the anti-tamper device may comprise an upper reinforcing panel which overlays, from outside, the top panel, above the locking device.

In still another aspect, the anti-tamper device may contain a bracket fastened to the top panel in the interior of the enclosure. The bracket is adapted for attaching lighting means, such as a flashlight.

BRIEF DESCRIPTION OF THE DRAWINGS

Although the characteristic features of the invention will be particularly pointed out in the claims, the invention itself, and the manners in which it may be made and used, may be better understood by referring to the following description, taken in consideration with the accompanying drawings forming part thereof, wherein;

DESCRIPTION OF THE PREFERRED EMBODIMENTS

Figure 1:
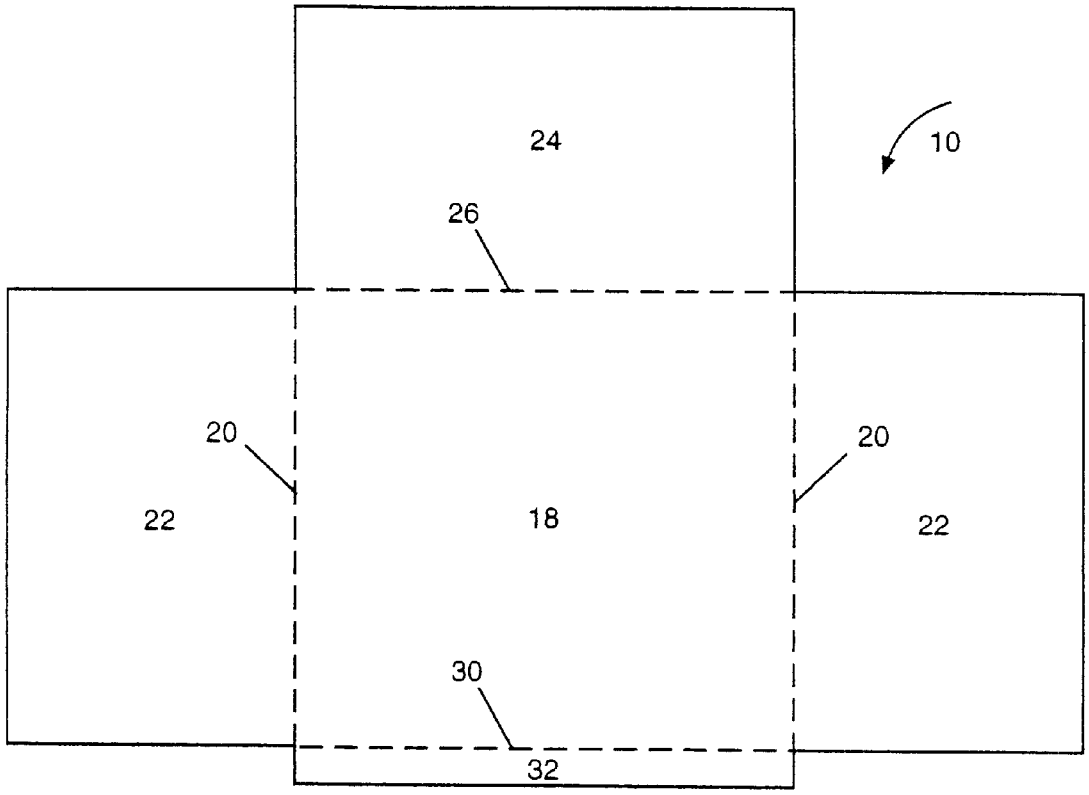
FIG. 1 is a flat-blank used for forming the enclosure, with dots showing the score lines for folding.
Figure 2:
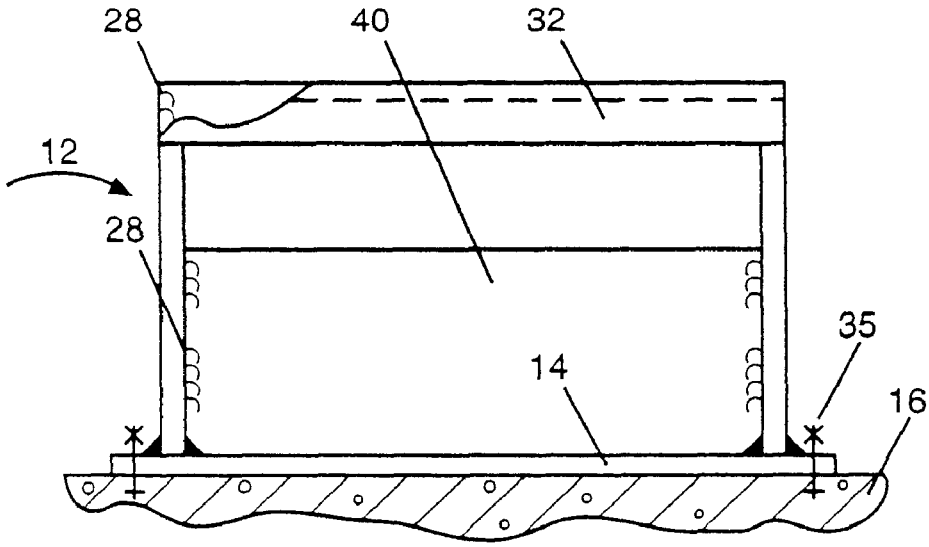
FIG. 2 is the front view of the enclosure together with the bottom plate.
Figure 3:
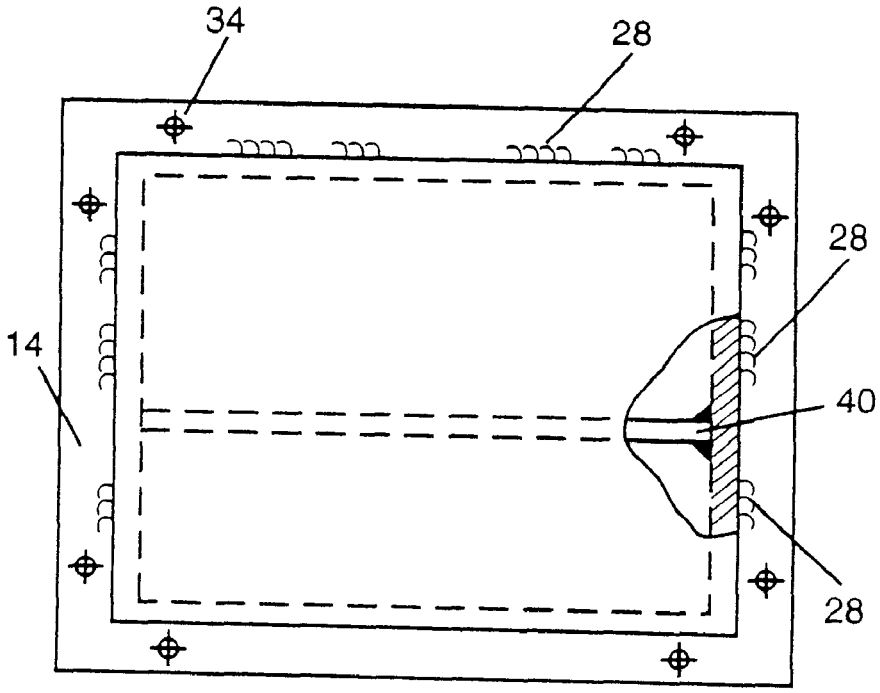
FIG. 3 is the plan view of assembly of FIG. 2.
Figure 4:
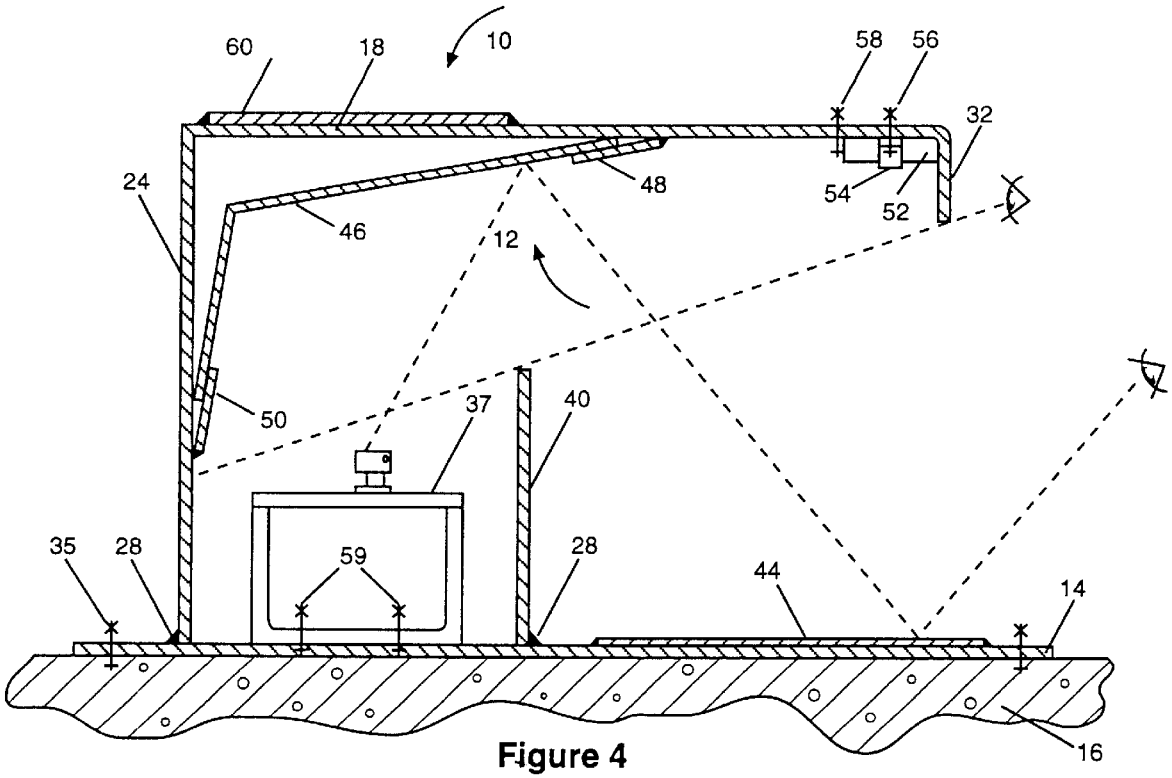
FIG. 4 is a longitudinal cross-section view of the anti-tamper device showing a lock box and a concrete vertical wall to which the device is fastened.
Figure 5:
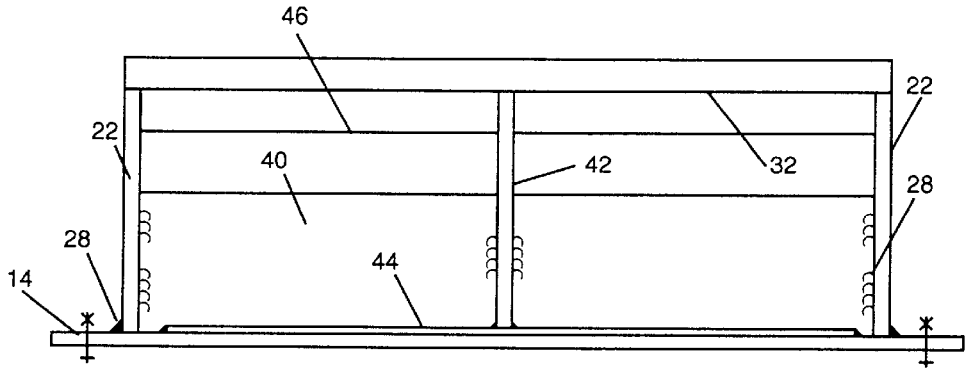
FIG. 5 is a front view of a large anti-tamper device, wherein a reinforcing separator wall is used.
Figure 6:
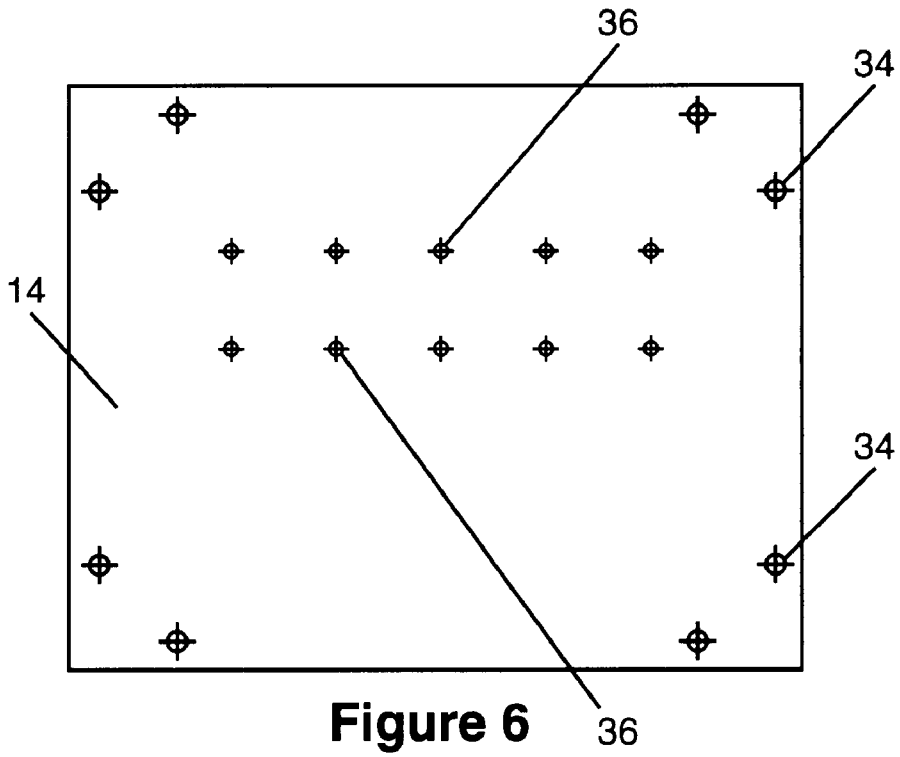
FIG. 6 is the plan view of the bottom plate with first holes (for attaching the enclosure with the bottom plate to a wall) and second holes (for attaching lock boxes to the bottom plate)
Figure 7:
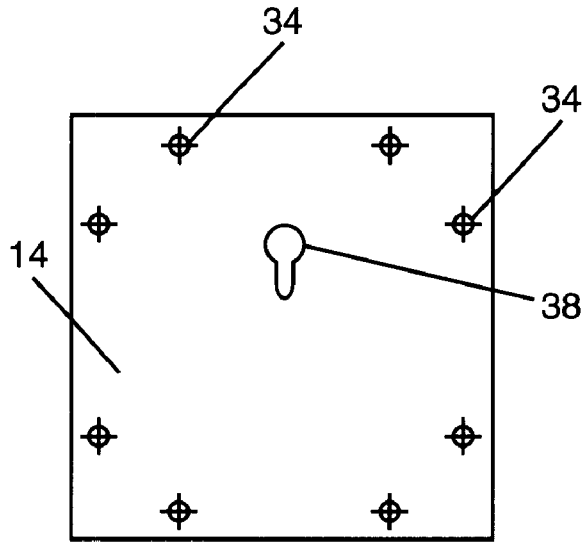
FIG. 7 is the plan view of the bottom plate with an aperture for accessing a keyhole.

Referring to the drawings, there is shown in FIG. 1 a flat-blank 10 cut out of a sheet of 3/16" mild steel. From illustrated flat-blank 10, an enclosure 12 (see FIG. 2) is formed. To enclosure 12 a bottom plate 14, adapted to lie flat against a concrete vertical wall 16, is permanently fastened.

It will be understood, that the plan view of three-dimensional enclosure 12 can be not only rectangular, as shown in the drawings, but square or another geometrical configuration is also possible, in which case the shape of flat-blank 10 will be modified accordingly. However, flat-blank 10, as formed, has been designed to, first of all, achieve the desired form of enclosure 12, and second of all, to minimize the amount of material used and the scrap material left behind.

The manner of erecting enclosure 12 from flat-blank 10 will be readily apparent from the following disposition of flat-blank panels. Thus, referring now more specifically to FIG. 1, flat-blank 10 includes a top panel 18 to which are integrally joined, along score lines 20, a pairs of side panels 22; a back panel 24 is also integrally joined, along a score line 26, to top panel 18. Side panels 22 are folded inwardly, along score line 20, until they are perpendicularly disposed to top panel 18, while back panel 24 is similarly folded along score line 26. The contacting edges of back panel 24 and side panels 22 are joined together by intermittent welds 28.

Referring again to FIG. 1, one can see how top panel 18 extends forwardly beyond side panels 22. The resulting extending portion forms, after being inwardly folded along the score line 30, so as to come in contact with adjacent edges of side panels 22, already erected, a first obstructing panel 32. The lateral edges of first obstructing panel 32 are joined by intermittent welds 28 to adjacent edges of side panels 22.

Bottom plate 14 has its surface larger than the plan projection of enclosure 12 and its provided, at its periphery, with first holes 34 for foundation type bolts 35. The latter are intended to attach the bottom plate 14 to concrete vertical wall 16. Bottom plate 14 is also provided with second holes 36 intended for attaching, in the interior of enclosure 12, of one or more lock boxes 37.

Optionally, bottom plate 14 can be provided, instead of second holes 36, with an aperture 38 for accessing a keyhole, located behind bottom plate 14. Enclosure 12 and bottom plate 14 are fastened together, at their contact zones, by intermittent welds 28. In the interior of enclosure 12, permanently fastened to bottom plate 14, a second obstructing wall 40 is erected perpendicularly to side panels 22 and to bottom plate 14. Second obstructing wall 40 is located proximate to lock boxes 37 or aperture 38 and extends so, as to leave an opening above it for permitting a hand with a key in it to access them.

The height of second obstructing wall 40 and the extension of first obstructing wall 32, which walls are parallel, are so coordinated, as to prevent anybody from seeing, behind said second obstructing wall 40, the position of the lock of lock boxes 37 or of the keyhole in aperture 38. The above coordination is also intended to render straight pry bars or other straight instruments of destruction inaccessible to the locks of lock boxes 37 or a keyhole in aperture 38. In the case of an enclosure 12 with a wide entrance opening, an intermediary-reinforcing panel 42, for providing rigidity to the assembly enclosure 12-bottom plate 14, is erected. Intermediary—reinforcing panel 42 is perpendicular to back panel 24 and to bottom plate 14 and starts at the entrance of enclosure 12, in the middle of it, behind first obstructing panel 32. Intermediary-reinforcing panel 42, which terminates at back panel 24, is provided with a slot for capturing second obstructing wall 40. Intermittent welds 28 are disposed where intermediary-reinforcing panel 42 contacts top panel 18, back panel 24, bottom plate 14, and first and second obstruction panels 32 and 40, respectively.

In order to render visible the locks during the insertion of a hand with a key, use is made of an entrance elongated mirror 44 and an internal plane-intersecting mirror 46. Entrance elongated mirror is attached permanently to bottom plate 14. Contact welding, for example, can be used for this attachment. Internal plane-intersecting mirror 46 is fastened by snapping to top panel 18 and to back panel 24. To this end, an upper tongue 48 and a back tongue 50 are firmly attached by welding to top panel 18 and, respectively, to back panel 24. The use of snapping is required by the fact, that initially, when lock boxes 37 are attached to bottom plate 14, more space for inserting and fastening the lock boxes 37 is necessary and, therefore, internal plane-intersecting mirror 46 must be temporarily removed. The visibility of a lock, situated behind second obstructing panel 40, is obtained, firstly, by reflecting the image of the lock to internal plane-intersecting mirror 46 and from the inclined surface of the latter to entrance elongated mirror 44. Both, entrance elongated mirror 44 and internal plane-intersecting mirror 46 are made of Ex-buff (trade name) stainless steel 340, gauge 22. Internal plane-intersecting mirror 46 comprises two intersecting planes, one inclined with respect to panel 24, the other with respect to top panel 18.

In order for entrance elongated mirror 44 to accomplish its purpose of reflecting the image of a lock, a source light is required. Thus, a flash-light 52 with an easy accessible on-off button is removably attached by a bracket 54. The latter is attached in the interior of enclosure 12, to top panel 18, behind first obstructing panel 32, so that flash-light 52 can slide into it. Bracket 54 is attached by screws 56. To prevent the removal of flash-light 52, but for changing its batteries, a blocking bolt 58 is threaded into top panel 18, in front of flash-light 52. To prevent unscrewing blocking bolt 58, the head of the latter requires the use of a special screwdriver. To prevent the removal of bottom panel 14 together with enclosure 12 from concrete vertical wall 16, the heads of anchor bolts 35, used for fastening, are welded to bottom plate 14. To eliminate the formation of a gap between the back of bottom plate 14 and concrete vertical wall 16, attaching screws with countersunk heads 59 are used.

Thus, bottom plate 14 will lie flat on concrete vertical wall 16. For enhancing the resistance of enclosure 12 against drilling of top panel 18, above the locks, and then, braking the locks, an upper reinforcing panel 60, made of drill-resistant steel is used. Upper reinforcing panel 60 overlays a portion of top panel 18, to which it is welded.

As required, detailed embodiments of the present invention has been disclosed above; however, it is to be understood that the disclosed embodiments are merely exemplary of the invention, which may be embodied in various forms. Therefore, specific structural and functional details, disclosed therein, are not be interpreted as limiting, but merely as a basis for teaching one skilled in the act to the variously employ of the present invention in virtually any appropriately detailed structure.

What is claimed is:

1. Anti-tamper device comprising, in combination an enclosure forming a unitary structure firmly attached to a bottom plate, the latter being adapted to be permanently secured to a wall, said enclosure containing a top panel;

a pair of side panels;

a back panel; and a first and second obstructing panels, said first obstructing panel extending perpendicularly from said top panel at an entrance of said enclosure, said second obstructing panel being parallel to said first obstructing panel and extending from said bottom plate in the interior of said enclosure, whereby a space having a size adapted for a hand with a key is formed between said first and second obstructing panels, said space, having a size adapted for a hand with a key, communicating with a hollow area behind said second obstructing panel, wherein, in said bottom plate, means adapted to accommodate one or more locking devices is provided, said space, having a size adapted for a hand with a key, being so chosen that there is no visibility from the outside of said enclosure, so as to determine weather there are or not locking devices in said enclosure and, especially, the position of their locks, and said space having a size adapted for a hand and a key being also so chosen, that there is no possibility of inserting a prying instrument, capable of reaching and damaging said locks.

2. Anti-tamper device, as defined in claim 1, further comprising an elongated metallic mirror, firmly attached to said bottom plate, at the entrance of said enclosure;

a plane-intersecting metallic mirror removably attached to said back and top panels, to which it is slantingly disposed and adapted to reflect the image of a locking device and the position of its lock;

means for removable attaching said plane-intersecting metallic mirror to said back and top panels; and lighting means, so located in the interior of said enclosure, so as to direct light to the locking device and make them visible in said elongated metallic mirror, after being reflected by said plane-intersecting metallic mirror.

3. Anti-tamper device as defined in claim 1 or 2, further comprising in the case of large enclosures, an intermediary-reinforcing panel, disposed perpendicularly to said bottom plate and said top panel, to both of which it is firmly attached, said intermediary reinforcing panel dividing said enclosures into substantially equal compartments.

4. Anti-tamper device, as defined in claim 1 or 2, further comprising an upper reinforcing panel overlaying said top panel, the former being firmly and permanently attached to the latter, whereby an access to said locking devices is supplementary prevented.

5. Anti-tamper device, as defined in claim 2, further comprising at least one bracket fastened in the interior of said enclosure to said top panel and adapted for attaching said lighting means.

6. Anti-tamper device comprising, in combination an enclosure forming a unitary structure firmly attached to a bottom plate, the latter being adapted to be permanently secured to a wall, said enclosure containing a top panel;

a pair of side panels;

a back panel;

a first and second obstructing panels, said first obstructing panel extending perpendicularly from said top panel at an entrance of said enclosure, said second obstructing panel being parallel to said first obstructing panel and extending from said bottom plate in the interior of said enclosure, whereby a space having a size adapted for a hand with a key is formed between said first and second obstructing panels, said space, having a size adapted for a hand with a key, communicating with a hollow area behind said second obstructing panel, wherein, in said bottom plate, means adapted to accommodate one or more locking devices is provided, said space, having a size adapted for a hand with a key, being so chosen that there is no visibility from the outside of said enclosure, so as to determine weather there are or not locking devices in said enclosure and, especially, the position of their locks, and said space having a size adapted for a hand and a key being also so chosen, that there is no possibility of inserting a prying instrument, capable of reaching and damaging said locks;

an elongated metallic mirror, firmly attached to said bottom plate, at the entrance of said enclosure;

a plane-intersecting metallic mirror removably attached to said back and top panels, to which it is slantingly disposed and adapted to reflect the image of a locking device and the position of its lock;

means for removable attaching said plane-intersecting metallic mirror to said back and top panels;

lighting means, so located in the interior of said enclosure, so as to direct light to the locking device and make them visible in said elongated metallic mirror, after being reflected by said plane-intersecting metallic mirror;

an intermediary-reinforcing panel, disposed perpendicularly to said bottom plate and said top panel, to both of which it is firmly attached, said intermediary reinforcing panel dividing said enclosures into substantially equal compartments; and an upper reinforcing panel overlaying said top panel, the former being firmly and permanently attached to the latter, whereby an access to said locking devices is supplementary prevented.-an elongated metallic mirror, firmly attached to said bottom plate, at the entrance of said enclosure.

* * * * *